US005129552A

United States Patent [19]

Painchaud et al.

[11] Patent Number: 5,129,552

[45] Date of Patent: Jul. 14, 1992

[54] MULTI-PURPOSE KEG TAPPER

[76] Inventors: Thomas A. Painchaud, 149 Broadway, Concord, N.H. 03301; Richard A. Sinapi, 1616 Cranston St., Cranston, R.I. 02920

[21] Appl. No.: 755,782

[22] Filed: Sep. 6, 1991

[51] Int. Cl.[5] ..... B67D 5/62

[52] U.S. Cl. ..... 222/146.6; 62/306; 62/389; 62/399; 222/183; 222/399

[58] Field of Search ..... 222/131, 146.1, 146.6, 222/183, 399, 400.7, 400.8; 62/306, 389, 391, 393, 398, 399

[56] References Cited

U.S. PATENT DOCUMENTS

| | | | |
|---|---|---|---|
| 519,708 | 5/1894 | Hahn | 62/389 |
| 681,056 | 8/1901 | Irr, Jr. | 62/391 |
| 889,140 | 5/1908 | Lehnbeuter et al. | 62/391 |
| 1,065,666 | 6/1913 | Dade | 62/399 |
| 1,772,111 | 8/1930 | Rice | 222/146.6 X |
| 2,001,040 | 5/1935 | Sweeney | 62/306 X |
| 2,541,709 | 2/1951 | Marx | 62/306 |
| 2,774,229 | 12/1956 | Thau et al. | 62/393 X |
| 2,792,692 | 5/1957 | Bryan | 222/146.6 X |
| 2,917,906 | 12/1959 | Woolley | 222/146.6 X |
| 3,180,529 | 4/1965 | Buffington | 222/399 X |
| 3,195,779 | 7/1965 | Nicko | 222/146.6 X |
| 3,231,143 | 1/1966 | Cserny | 222/399 X |
| 3,232,489 | 2/1966 | Buffington | 222/399 X |
| 3,354,668 | 11/1967 | Cserny | 222/399 X |
| 3,403,820 | 10/1968 | Landis et al. | 222/399 X |
| 3,712,514 | 1/1973 | LeBlanc | 222/399 X |
| 3,865,276 | 2/1975 | Thompson | 222/146.6 |
| 4,225,059 | 9/1980 | Kappos | 222/146.6 |
| 4,350,267 | 9/1982 | Nelson et al. | 222/399 X |
| 4,844,300 | 7/1989 | Simons et al. | 222/399 X |

FOREIGN PATENT DOCUMENTS

| | | | |
|---|---|---|---|
| 74623 | 4/1894 | Fed. Rep. of Germany | 62/398 |
| 3831227 | 3/1990 | Fed. Rep. of Germany | 222/146.6 |

*Primary Examiner*—Kevin P. Shaver
*Attorney, Agent, or Firm*—Robert J. Doherty

[57] ABSTRACT

A multi-purpose, generally cylindrical, multi-compartmented device for disposition and support by the upper portions of a beer keg such that beer may be dispensed therefrom. The various compartments provide the space for the tapping, cooling and gas containment functions desirable in dispensing the like from a keg. In addition, the device can be used as a self-contained cooling container for picnics and the like.

7 Claims, 2 Drawing Sheets

MULTI-PURPOSE KEG TAPPER

BACKGROUND AND OBJECTS OF THE INVENTION

This invention relates to a device designed for use with a keg container such as a beer keg or the like. More specifically, the invention is directed to a portable device adapted for disposition on top of a beer keg such that beer may be dispensed therefrom in a more formal manner and to some extent mask the beer keg's presence and/or appearance. The invention while primarily directed to a device which regulates both pressure and temperature in a self-contained unit additionall provides a device which can alternatively be used as an unique picnic cooler which has separate and/or additional utility apart from its primary usage when connected to a beer keg. To these and other purposes, the device is provided with a number of separate compartments including a compartment for a compressed gas source, a cooling compartment and a utility or tapping compartment such that all the necessary equipment required to store, temperature regulate and dispense a beverage such as beer and the like at its consumption point is provided in a self-contained, easily portable unit which masks and thus enhances the beer keg's appearance.

As such, the device or unit of the present invention is particularly suited for rental to those who purchase beer kegs, but it should be brought out that such is not restricted to such use and many adults and those accustomed to giving parties at which such beverage is provided would ideally wish to purchase and have conveniently available such a unit or device.

Prior art devices have been suggested which provide some features of the present invention. Namely, U.S. Pat. No. 3,865,276 issued Feb. 11, 1975 to Thompson describes a unit which is essentially a cooling chamber adapted for mounting in the top of a beer keg in the upper recess thereof and adapted for use with a separately contained pressurized gas source such as a free standing gas bottle. Other devices of this very general type of which the present inventors are aware include those set forth in the following U.S. patents: U.S. Pat. No. 1,772,111 to Rice issued Aug. 5, 1930; U.S. Pat. No. 2,774,229 to Thau et al issued Dec. 18, 1956; U.S. Pat. No. 2,792,692 to Bryan issued May 21, 1957; U.S. Pat. No. 2,861,603 to Terlecki issued Nov. 25, 1958; and U.S. Pat. No. 2,917,906 to Woolley issued Dec. 22, 1959.

There remains, however, a need for a multi-purpose unit which when associated with a beer keg provides the necessary cooling and dispensing functions of prior art devices yet does so in a manner in which the dispensing thereof is enhanced through the provision of a self-contained unit including all the necessary equipment for cooling and dispensing beer and additionally enables the unit to function as a self-contained picnic unit in which food stuffs and the like can be contained as a separate function of the device. Accordingly, these and other objects of the present invention are accomplished by a combination tapping and serving device for use with a beer keg of the type having a generally cylindrical barrel terminating at its upper end in a recessed top wall defined by an upstanding peripheral side wall terminating in an upper circular ledge wherein said top wall includes a normally sealed tapping aperture adapted to be opened by receipt of a tapping assembly slidably sealingly inserted therethrough, said device comprising a generally cylindrical multi-compartmented body having side walls and upper and lower ends and terminating at its lower end in a circular skirt in which a bottom wall adapted for supporting disposition upon the beer keg upper circular ledge is upwardly recessed such that said skirt downwardly extends over at least a portion of said keg upper end to give a unitary appearance to said keg and said device when said device is disposed upon said keg in the above described fashion, said device body including forward and rear sides and said compartments including a compartment disposed at the rear side thereof for receipt of a pressurized gas container and an ice containing cooling compartment disposed at the forward side thereof, said body further including a dispensing faucet disposed at the forward side thereof adjacent said cooling compartment and a tapping assembly including a tap and a gas delivery tube and a beer delivery tube respectively having opposed ends, said gas delivery tube connected to said gas container at one end thereof and to said tap at the other end thereof, said beer delivery tube connected to said tap at one end and to said dispensing faucet at the other end, and wherein said device bottom wall includes an opening through which said tap can extend for operational contact with said keg tapping aperture.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DETAILED DESCRIPTION OF THE INVENTION

Figure 1:
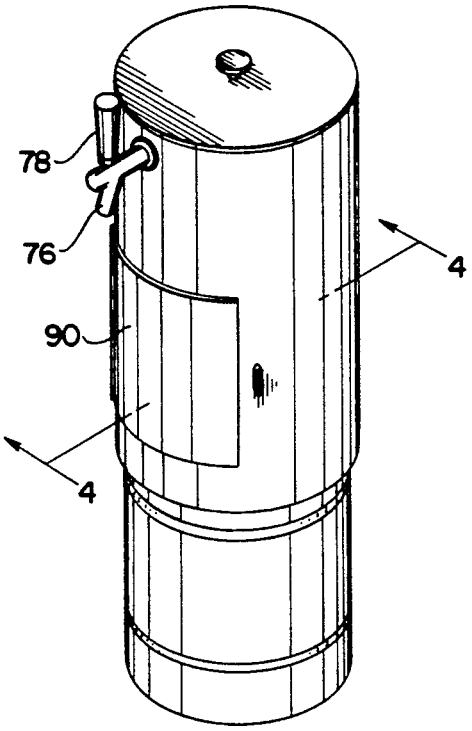
FIG. 1 is a perspective view showing the device of the present invention mounted upon a beer keg in the intended manner of use.
Figure 2:
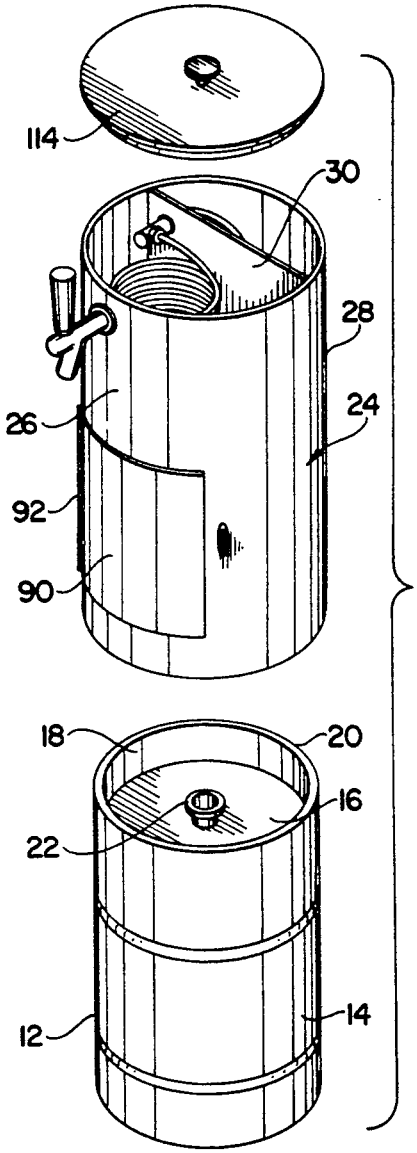
FIG. 2 is a view similar to FIG. 1 but showing the device in disassembled relationship to the beer keg to better define their spacial relationship in use.
Figure 3:
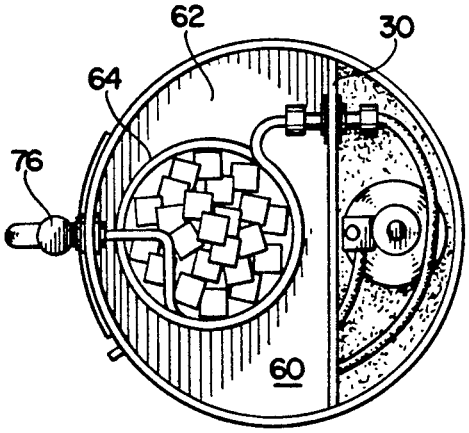
FIG. 3 is a top view of the device of the present invention with the cover thereof removed.
Figure 4:
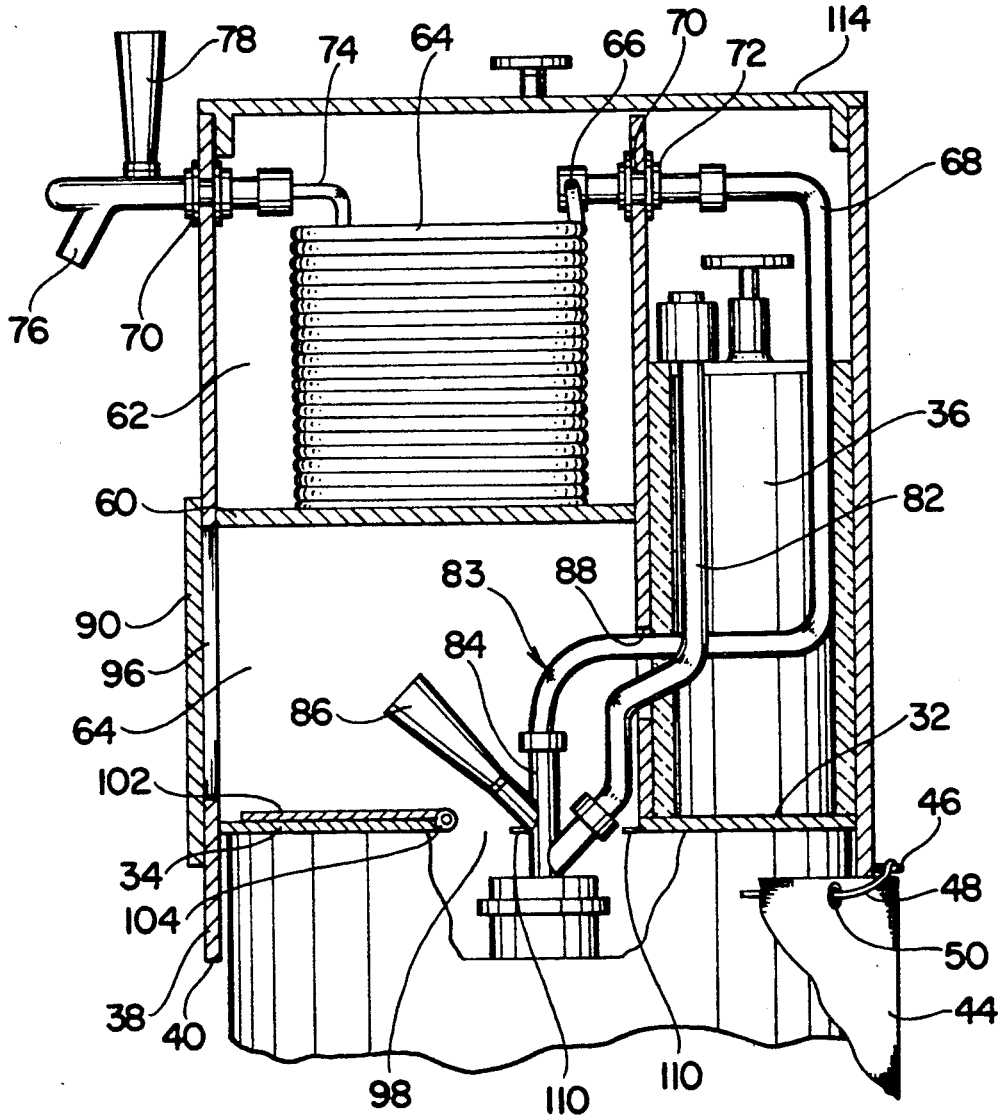
FIG. 4 is a vertical section along the line 4—4 of FIG. 1.

Turning now to the drawings and particularly FIGS. 1 and 2 thereof, the device 10 of the present invention is shown disposed upon a beer keg or similar container 12. The beer keg 12 with which the device of the present invention is adapted to co-function is of a standard construction and includes a side wall 14 which may be straight as shown in the drawings or may contain a somewhat traditional outwardly bowed appearance. In addition, the keg 12 includes a bottom wall (not shown), and a top wall 16 which is recessed below a peripheral flange 18 which terminates in a circular ledge 20 on which the device 10 of the present invention is adapted to primarily rest as best shown in FIGS. 1 and 4 of the drawings. The top wall 16 is provided with a normally sealed tapping aperture 22 of standardly construction and adapted to receive a standard constructed tapping assembly which will be more fully described hereinafter.

The device 10 has a generally cylindrical body 24 having a forward side wall portion 26 and a rearward side wall portion 28 in turn defined by a chordally vertically extending interior wall 30. The bottom of body 24 includes a bottom wall which in turn is composed of a rear bottom wall portion 32 and a forward bottom wall portion 34, the construction of which will be more fully explained hereinafter. In that regard, the rear bottom wall portion 32, the vertical wall 30 and the rear side wall portion 28 cooperatively form a rear compartment specifically adapted for the receipt of a pressurized gas container 36 and component portions of a tapping assembly 83.

The lower wall, that is, the bottom wall formed by the cooperative wall portions 32 and 34, serve to form the structure necessary to permit the device 10 to be mounted upon the beer keg 12 top in the intended manner. In this regard, the bottom wall is adapted to rest upon the circular ledge 20. Also and as best shown in FIGS. 1 and 4, a lower cylindrical skirt portion 38 extends below the keg upper portions to mask such from view and to attempt to give a unitary appearance to the two units when assembled and in use position is shown in FIG. 1. Not only does such disposition give a slightly more formal appearance to the assembled unit and thus to some extent tone down the image of a fraternity keg party but additionally places the unit at an ideal height for dispensing which will be discussed hereinafter. In some cases, the skirt 38 terminal portion 40 may be adapted to contact the keg 12 upper side wall portions especially when a keg is shaped in the traditional central bowed-out side wall configuration.

In such cases and especially when the keg side wall 14 is perfectly cylindrical, this relationship of the skirt's disposition downwardly over the top of the keg serves to more positively anchor such vis-a-vis the keg and to reduce the possibility of the device 10 being dislodged therefrom either by contact therewith during normal use or from inadvertent or even purposeful sideward contact therewith. It should also be pointed out that a vanity or style cover formed of fabric, plastic sheet material or the like formed into a cylindrical form may be additionally attached to the skirt 38 either through placement of temporary adhesive on the outside lower portion surface 38 or by the provision of circumferentially-spaced eyelets 46 through the skirt adapted for attachment with cord or rope 48 via eyelets 50 formed in the upper peripheral surface of the vanity cover 44. Such additional structure would completely cover the keg's presence, if desired.

The forward side wall portion 26 of the body 24 preferably includes an intermediate wall 60 which is attached to the vertical wall 30 at a point intermediate its height thereof and extends forwardly and attaches to the side wall to define a cooling compartment 62 disposed thereabove and a tapping compartment 64 disposed therebelow. The cooling compartment 62 receives a conduit coil 65 suitable for the transmission of beer therethrough and attached at its upstream end 66 to a fluid dispensing tube 68 forming a part of the tapping assembly 83. An opening 70 is provided through the vertical wall 30 for such purpose and suitable grommets or other sealing devices 72 utilized for such purpose.

The other end or downstream end 74 of the cooling conduit 65 is provided with a beer dispensing unit 76 having an operable handle 78. Similar grommets 70 are provided on opposite sides of the forward side wall portion 26 through an opening 80 disposed therethrough. It should be pointed out that the relative height at which the dispensing unit or spigot 76 is disposed is roughly twice the height of a standard beer keg and thus a particularly desirable height for beer dispensing so that people at the function do not have to bend down to accomplish such act. Furthermore, the coil 65 forms a natural container for holding ice in the interior portions thereof. Ice may be additionally provided in the remaining compartment 62 portions outside the coil 64—the purpose of which is obviously to provide the dispensed beer at a desirably low temperature for taste and foam reduction considerations.

The tapping assembly 83 further includes a conduit 82 for high pressure gas such that it may be transmitted via the gas container 36 into the tap 84 and hence into the beer keg 12 via the operation of a standard "on/off" lever 86. Suitable openings or opening 88 is provided in the intermediate wall 30 lower portion such that the tubes 68 and 82 may be operationally connected to the tap 84. Furthermore, the tapping compartment 64 provides space for the operable presence of the tap 84 and entrance thereto is accomplished through a door 90 preferably hingedly connected to the forward side wall portion 26 by a hinge 92 and a catch 94 such that the access door 90 covers an opening 96 in turn provided in the forward side wall portion 26. In this manner then, the access door 90 may be opened and the tapping apparatus 83 manipulated in the desired manner such that the tap 84 can be inserted into operational contact with the keg sealing aperture 22 and the keg pressurization accomplished by movement of the handle 86. The lower wall forward portion 34 is provided with an opening 98 for such purpose which opening 98 is conveniently formed by a secondary forward lower wall portion 102 which is hingedly connected to portion 34 with a hinge 104. Thus when the device 10 is used in a secondary form as a cooling or picnic self-contained container, the secondary wall portion 102 which essentially forms a hinged flap can be rotated to a flat position so as to close the opening 98. One or more steps 110 are provided which extend into the opening 98 either from the intermediate vertical wall 30 or from side wall interior portions such that the flap 102 is firmly supported thereby.

Accordingly, it will be apparent from the above description that a multi-purpose, multi-compartmented highly useful device is provided by the subject invention.

What is claimed is:

1. A combination tapping and serving device for use with a beer keg of the type having a generally cylindrical barrel terminating at its upper end in a recessed top wall defined by an upstanding peripheral side wall terminating in an upper circular ledge wherein said top wall includes a normally sealed tapping aperture adapted to be opened by receipt of a tapping assembly slidably sealingly inserted therethrough, said device comprising a generally cylindrical multi-compartmented body having side walls and upper and lower ends and terminating at its lower end in a circular skirt in which a bottom wall for supporting disposition upon the beer keg upper circular ledge is upwardly recessed such that said skirt downwardly extends over at least a portion of said keg upper end to give a unitary appearance to said keg and said device when said device is disposed upon said keg, said device body including forward and rear sides and said compartments including a compartment disposed at the rear side thereof for receipt of a pressurized gas container and an ice containing cooling compartment disposed at the forward side thereof, said body further including a dispensing faucet disposed at the forward side thereof adjacent said cooling compartment and a tapping assembly including a tap and a gas delivery tube and a beer delivery tube respectively having opposed ends, said gas delivery tube connected to said gas container at one end thereof and to said tap at the other end thereof, said beer delivery tube connected to said tap at one end and to said dispensing faucet at the other end, and wherein said device bottom wall includes an opening through which said tap extends for operational contact with said keg tapping aperture.

2. The device of claim 1, there being at least three separate compartments including a tapping compartment located forward of said gas container compartment and beneath said cooling compartment.

3. The device of claim 2, said device body including a vertical wall chordally disposed across said body, said vertical wall connected to said bottom wall at its lower end and in turn defining said forward and rear sides wherein that portion of the interior space of the device body to the rear of said vertical wall comprises said gas container compartment.

4. The device of claim 3, said device body having an intermediate wall extending from a point intermediate the vertical extent of said vertical wall forwardly to the body side walls so as to define said cooling compartment above said intermediate wall and said tapping compartment below said intermediate wall.

5. The device of claim 2, said body side wall including a door panel at the forward side thereof adjacent to said tapping compartment and providing access thereto.

6. The device of claim 4, the bottom of said tapping compartment being defined by that portion of said device bottom wall disposed forward of said vertical wall and wherein said bottom wall forward portion includes a first forwardly disposed panel and a second rearwardly disposed panel in turn chordally hinged to said first panel and adapted for disposition thereover so as to define said device bottom wall opening.

7. The device of claim 1, wherein said skirt is disposed in face to face disposition with upper portions of said keg for added support thereby.

* * * * *